US005118176A

United States Patent [19]

Motley, Sr.

[11] Patent Number: 5,118,176

[45] Date of Patent: Jun. 2, 1992

[54] SHOE SUPPORT APPARATUS

[76] Inventor: Raymond W. Motley, Sr., 514 W. Hampton Ave., Sumter, S.C. 29150

[21] Appl. No.: 657,149

[22] Filed: Feb. 19, 1991

[51] Int. Cl.[5] ..... A47B 49/00

[52] U.S. Cl. ..... 312/305; 312/297; 211/34; 211/163; 160/237

[58] Field of Search ..... 312/305, 267, 297; 211/34, 36, 37, 163; 160/237, 290.1, 23.1

[56] References Cited

U.S. PATENT DOCUMENTS 1,413,862 4/1922 MacDonald ..... 211/34 X
2,326,064 8/1943 Pittman ..... 312/305
3,425,564 2/1969 Allsop ..... 211/163 X
3,868,157 2/1975 Robinson ..... 312/305
4,585,127 4/1986 Benedict ..... 211/34
4,796,960 1/1989 Candelas ..... 312/305

*Primary Examiner*—Kenneth J. Dorner
*Assistant Examiner*—Brian K. Green
*Attorney, Agent, or Firm*—Leon Gilden

[57] ABSTRACT

An elongate, coaxially aligned housing rotatably mounted to a carousel interiorly thereof, with the carousel including a plurality of planar support plates angularly inclined relative to each vertical wall of the carousel, with a window opening mounted overlying and coextensive with an upper terminal edge of each planar support for securing an upper portion of a shoe therewithin.

2 Claims, 4 Drawing Sheets

SHOE SUPPORT APPARATUS

BACKGROUND OF THE INVENTION

1. Field of the Invention

The field of invention relates to shoe support apparatus, and more particularly pertains to a new and improved shoe support apparatus wherein the same provides an enclosed carousel structure rotatably mounted within an elongate housing to provide access to one of a plurality of shoes contained within each vertical wall of the carousel.

2. Description of the Prior Art

The storage and support of a plurality of shoe pairs presents an obstacle in many households where limited space is available. Various storage apparatus has been set forth in the prior art to support such shoe structure, but frequently requires use of an inordinate space within closets and the like. The instant invention attempts to overcome deficiencies of the prior art by providing a self-enclosed transportable storage closet utilizing a carousel contained within the storage closet structure to mount a plurality of shoe pairs in a readily viewable and accessible manner. Examples of the prior art include U.S. Pat. No. 4,036,367 to Stambaugh wherein a shoe rack utilizes a wire-like framework to mount a plurality of shoes thereon in a rotatable manner.

U.S. Pat. No. 4,549,714 to Busch provides a rotatable rack utilizing a top planar storage surface for mounting of various components thereon.

U.S. Pat. No. 4,603,781 to Ryan sets forth a shelf structure for fixed securement to a vertical wall for storage of various objects thereon.

U.S. Pat. No. 4,858,772 to Phillipson sets forth a carousel structure utilizing a wire-like framework to mount various shoes and the like thereon on hooks formed on the carousel.

As such, it may be appreciated that there continues to be a need for a new and improved shoe support apparatus as set forth by the instant invention which addresses both the problems of ease of use as well a effectiveness in construction and in this respect, the present invention substantially fulfills this need.

SUMMARY OF THE INVENTION

In view of the foregoing disadvantages inherent in the known types of shoe support apparatus now present in the prior art, the present invention provides a shoe support apparatus wherein the same provides for a transportable enclosure mounting a carousel interiorly thereof, wherein the carousel is arranged for support of a plurality of shoe pairs thereon, with optional coverings provided for each of the shoe pairs. As such, the general purpose of the present invention, which will be described subsequently in greater detail, is to provide a new and improved shoe support apparatus which has all the advantages of the prior art shoe support apparatus and none of the disadvantages.

To attain this, the present invention provides an elongate, coaxially aligned housing rotatably mounted to a carousel interiorly thereof, with the carousel including a plurality of planar support plates angularly inclined relative to each vertical wall of the carousel, with a window opening mounted overlying and coextensive with an upper terminal edge of each planar support for securing an upper portion of a shoe therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claim be regarded as including such equivalent constructions insofar as they do not depart from the spirit and scope of the present invention.

It is another object of the present invention to provide a new and improved shoe support apparatus which may be easily and efficiently manufactured and marketed.

It is a further object of the present invention to provide a new and improved shoe support apparatus which is of a durable and reliable construction.

An even further object of the present invention is to provide a new and improved shoe support apparatus which is susceptible of a low cost of manufacture with regard to both materials and labor, and which accordingly is then susceptible of low prices of sale to the consuming public, thereby making such shoe support apparatus economically available to the buying public.

Still yet another object of the present invention is to provide a new and improved shoe support apparatus which provides in the apparatuses and methods of the prior art some of the advantages thereof, while simultaneously overcoming some of the disadvantages normally associated therewith.

Still another object of the present invention is to provide a new and improved shoe support apparatus wherein the same provides for a selectively positionable cabinet member containing a carousel therewithin to provide for a shoe support structure to maintain shoes in a relatively clean environment free of debris.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
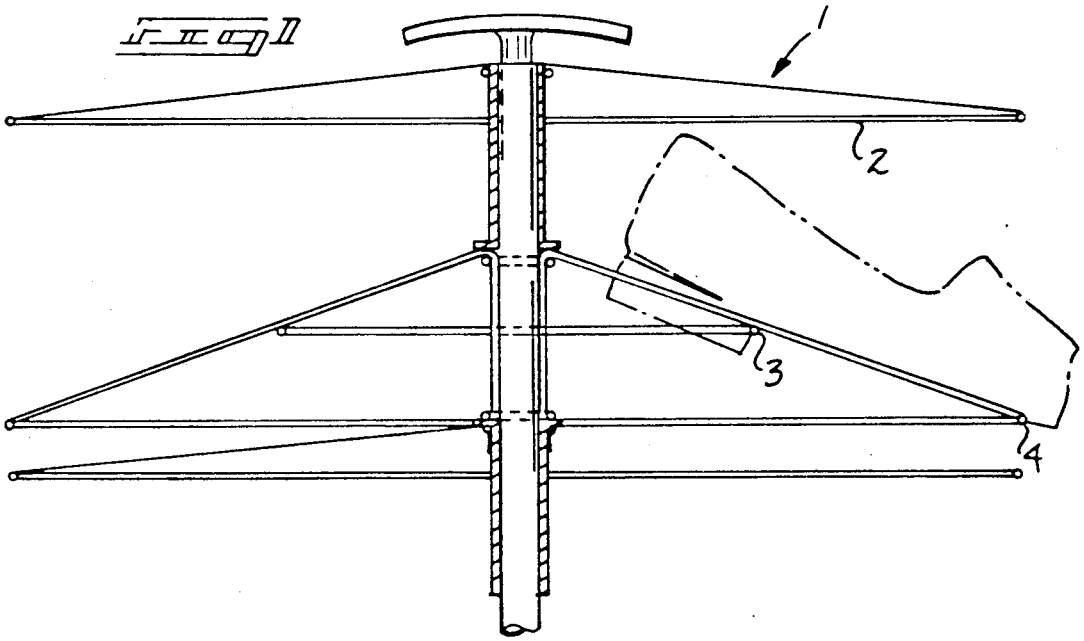
FIG. 1 orthographic side view of a prior art shoe support apparatus.
Figure 2:
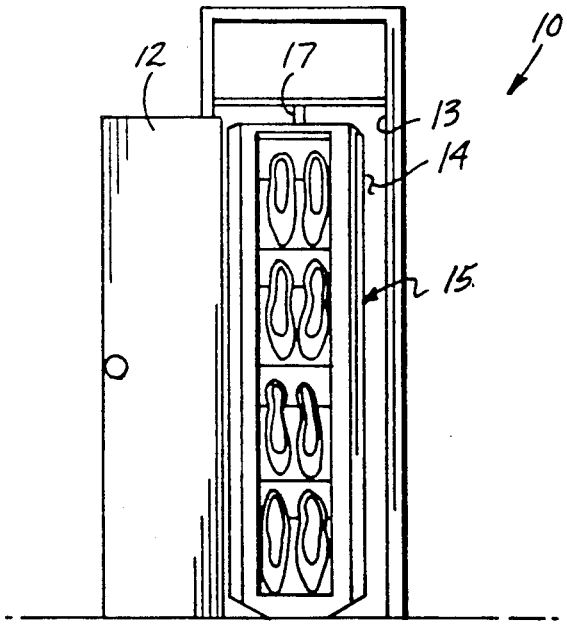
PRIOR ART Fig 2
FIG. 2 is an orthographic side view of the instant invention.
Figure 3:
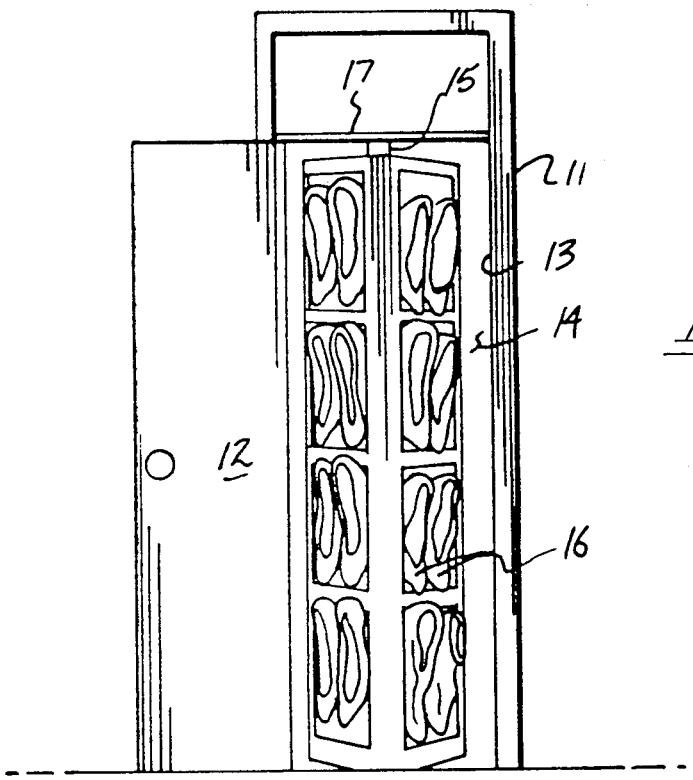
FIG. 3 an orthographic side view of the instant invention illustrating the carousel in a rotated orientation relative to the cavity of the cabinet.
Figure 4:
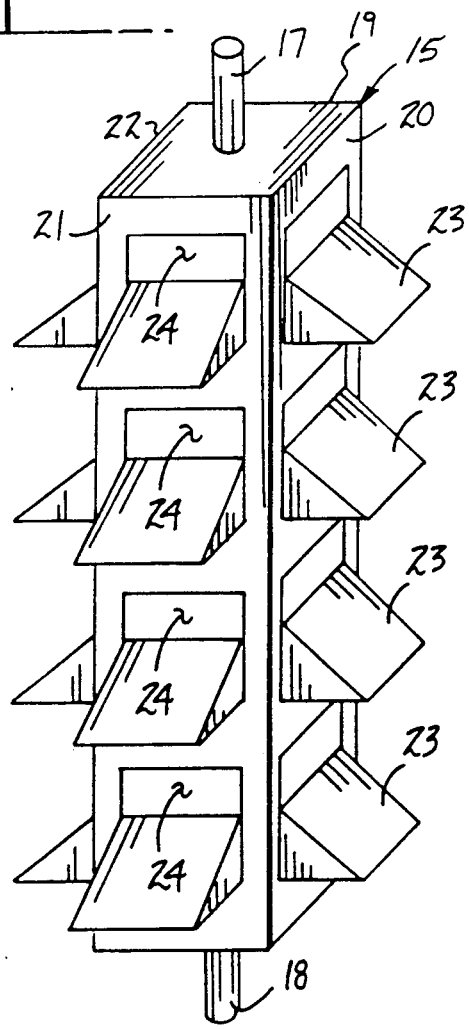
FIG. 4 is an isometric illustration of the carousel structure of the instant invention.

With reference now to the drawings, and in particular to FIGS. 1 to 8 thereof, a new and improved shoe support apparatus embodying the principles and concepts of the present invention and generally designated by the reference numeral 10 will be described.

FIG. 1 is illustrative of a prior art shoe support apparatus 1, including spaced wire racks 2, including a forward circular rod-like member 4 supporting a forward portion of an associated shoe, and a rear rod-like member 3 supporting a rear portion of the shoe.

Figure 5:
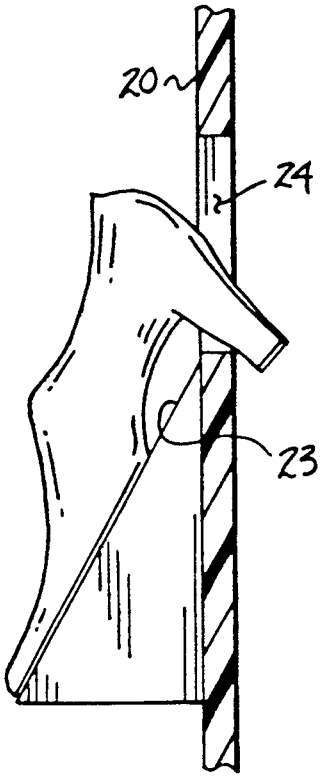
FIG. 5 is an orthographic side view of a shoe support plate structure utilized by the instant invention.

More specifically, the shoe support apparatus 10 of the instant invention essentially comprises an elongate, coaxially aligned cabinet 11, including an entrance opening 13, with a door 12 hingedly mounted to the entrance opening 13 complementarily mounted therewithin selectively enclosed of the entrance opening defining a cavity 14 therewithin. Rotatably mounted within the cavity 14 and coaxially aligned with the cabinet 11 is a carousel 15. The carousel 15 includes an upper axle 17 and a lower axle 18 coaxially aligned with the carousel, with the carousel mounting plural pairs of shoes 16 upon planar, inclined support plates 23 (see FIGS. 4-6 for example) mounted in longitudinal alignment on each side wall of the carousel, wherein the carousel is defined by a first, second, third, and fourth side wall 19, 20, 21, and 22 respectively. The side walls define a square parallelepiped configuration. Further, the support plates 23 define an obtuse included angle between a top surface of each support plate 23 and a respective side wall. Further, the planar support plates 23 project radially outwardly relative to the carousel 15 and are positioned with an upper terminal edge of each support plate coextensively aligned relative to an overlying support window 24. Reference to FIG. 5 exemplifies the use of each support window 24, wherein a rear or heel portion of an associated shoe is support within each support window and the sole portion of each shoe mounted upon an associated support plate 23. Mere rotation of the carousel selectively presents, as desired, each side wall for presentation of each aligned column of support plates.

Figure 6:
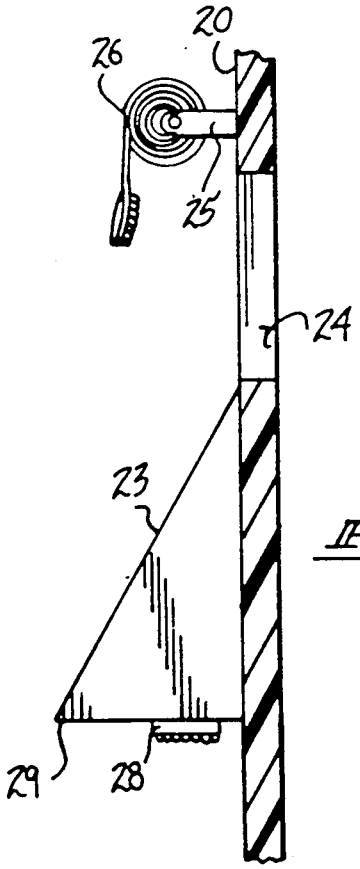
FIG. 6 an orthographic side view of a modified shoe support plate structure utilized by the instant invention.

Reference to FIG. 6 illustrates a modified support plate structure, wherein the support plate 23 includes a radial plate 29 orthogonally and fixedly mounted to each respective side wall and fixedly and coextensively mounted to a lower terminal end of each support plate 23 intersecting the support plate, as illustrated in FIG. 6 for example. A support bracket 25 is positioned above each associated support window, as exemplified by the organization as set forth in FIG. 6 and merely duplicated by each support window and support plate structure, wherein the support bracket 25 pivotally mounts a roll of transparent polymeric covering web 26 to selectively overlie each shoe pair on an associated support plate 23 to further protect each shoe pair from dust, debris, and the like. A forward terminal edge of the covering web 26 includes a first hook and loop fastener member 27 mounted thereto and securable to a second hook and loop fastener member 28 mounted to the radial plate 29 to selectively secure and completely overlie a respective shoe pair.

Figure 7:
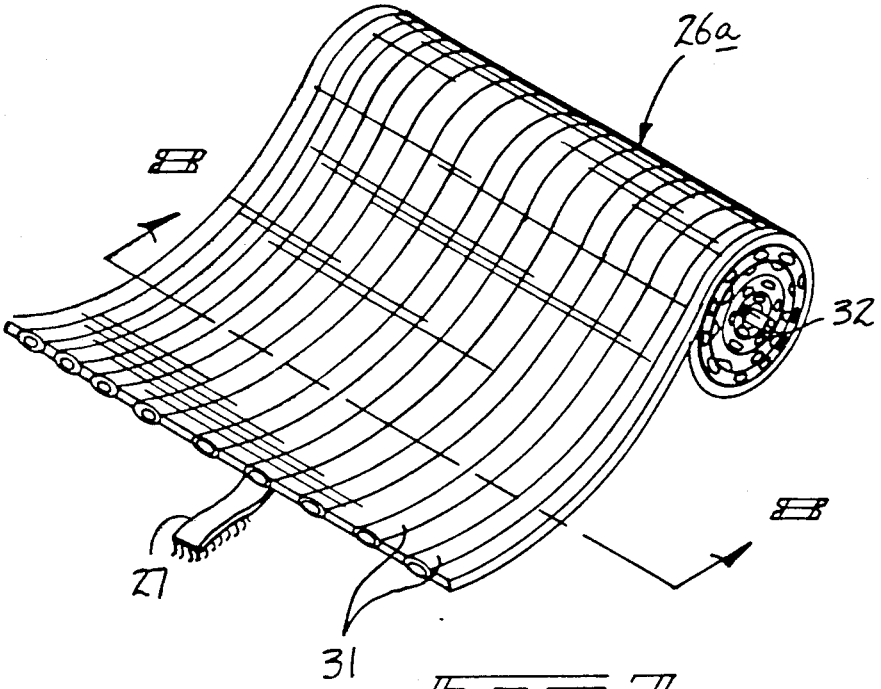
FIG. 7 is an isometric illustration of a modified covering web utilized the instant invention.
Figure 8:
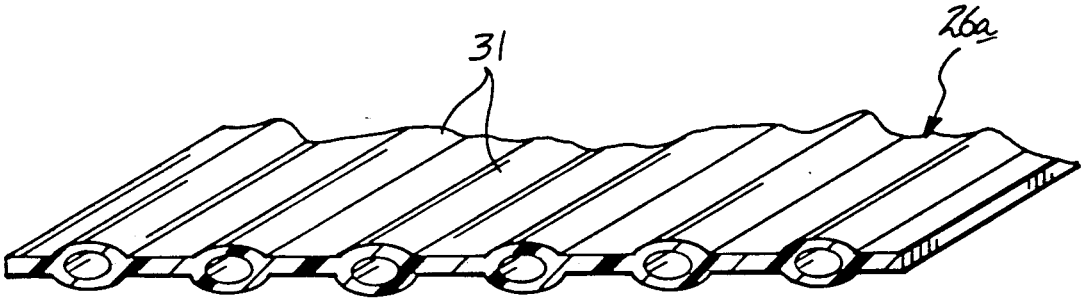
FIG. 8 is an orthographic view, taken along the lines 8—8 of FIG. 7 of the modified covering web as illustrated.

Reference to FIG. 7 illustrates a modified web structure 26*a*, wherein the web structure includes tubular ribs 31 that extend longitudinally of and coextensively of each web extending from the forward terminal edge of each web, with each of the ribs arranged parallel relative to one another to prevent the web 26*a* from adhering to an associated shoe pair allowing air circulation between the web and the shoe pair.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as is illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shoe support apparatus comprising, an elongate cabinet, the cabinet including an entrance opening, a door hingedly mounted to the cabinet, and the cabinet defining a cavity, wherein the cavity includes a caroucel rotatably mounted within the cavity and coaxially aligned with the cabinet, the carousel including a plurality of side walls, wherein each of the side walls includes a plurality of equally spaced inclined support plates defining an obtuse angle between a top surface of each of the support plates and a respective side wall, and each of the support plates is arranged for mounting a shoe pair thereon, and wherein each of the support plates includes a respective upper terminal edge and a lower terminal edge, wherein each respective upper terminal edge and the lower terminal edge are arranged parallel relative to one another, and a support window is located above each of the support plates, wherein a support window lower edge is formed by the support plate upper terminal edge, and a radial plate mounted fixedly to the lower terminal edge of each of the support plates to fixedly mount each of the lower terminal edges relative to the respective side walls, and wherein a support bracket is mounted above each window, and each support bracket includes a roll of transparent covering web, each covering web including a web forward terminal edge, and each of the forward terminal edges mounting a first hook and loop fastener thereto, and a second hook and loop fastener member mounted to the radial plate for securement of the first hook and loop fastener to the second hook and loop fastener member to overlie a respective shoe pair mounted upon each of the support plates.

2. An apparatus as set forth in Claim 1 wherein the covering web includes a plurality of parallel tubular ribs formed coextensively through the covering web oriented orthogonally relative to the covering web forward terminal edge.

* * * * *